United States Patent [19]

Bako

[11] 4,123,923

[45] Nov. 7, 1978

[54] COMBINATION LOCK

[75] Inventor: Lazlo Bako, Woodcliff Lake, N.J.

[73] Assignee: Presto Lock Company, division of Walter Kiddie & Company, Inc., Garfield, N.J.

[21] Appl. No.: 855,602

[22] Filed: Nov. 29, 1977

[51] Int. Cl.[2] ..... E05B 37/02; E05B 65/48

[52] U.S. Cl. ..... 70/74; 70/312; 70/316

[58] Field of Search ..... 70/68–76, 70/287–288, 304–306, 312, 315–318

[56] References Cited

U.S. PATENT DOCUMENTS

| | | | |
|---|---|---|---|
| 3,597,945 | 8/1971 | Feinberg | 70/74 |
| 3,736,778 | 6/1973 | Bako | 70/70 |
| 3,800,571 | 4/1974 | Heime | 70/71 |
| 3,952,561 | 4/1976 | Bako | 70/70 |

*Primary Examiner*—Robert L. Wolfe

*Attorney, Agent, or Firm*—Shapiro and Shapiro

[57] ABSTRACT

A combination lock in which an actuator is movable in a predetermined direction from a rest position to an unlocking position to unlock the lock and is further movable in the predetermined direction beyond the unlocking position to a combination-changing position to permit the combination to be changed. Movement of the actuator to the unlocking position can only occur when combination dials and sleeves coupled thereto are "on-combination". In the combination-changing position of the actuator, the sleeves are uncoupled from the dials. A stop mechanism is normally effective to prevent movement of the actuator to the combination-changing position and is rendered ineffective by depressing a plunger. The same stop mechanism holds the actuator at the combination-changing position during changing of the combination.

13 Claims, 16 Drawing Figures

COMBINATION LOCK

BACKGROUND OF THE INVENTION

This invention relates to combination or permutation locks, for luggage, for example, and is particularly concerned with combination locks in which the combination may be changed by the user.

Combination locks which permit the user to change the combination are well-known. See, for example, U.S. Pat. Nos. 3,416,338; 3,597,945; and 3,720,082, all assigned to the same assignee as the present invention. In the combination locks disclosed in U.S. Pat. Nos. 3,416,338 and 3,597,945, a plurality of combination dials and cooperating sleeves rotate about a common axis. The sleeves are normally coupled to corresponding dials for rotation therewith. Except when the dials are on-combination, the sleeves block movement of a slide relative to the sleeves that is required to open the lock. To change the combination, the sleeves are uncoupled from the corresponding dials by moving the sleeves axially relative to the dials. In the combination lock of U.S. Pat. No. 3,720,082, sleeves are moved axially in one direction relative to the combination dials to open the lock and are moved axially in the opposite direction to permit the combination to be changed. The present invention is in some respects an improvement upon the combination locks of the aforesaid patents, particularly with respect to the changing of the combination.

BRIEF DESCRIPTION OF THE INVENTION

It is accordingly a principal object of the present invention to provide an improved combination lock.

A further object of the invention is to provide an improved combination lock in which the same actuator is employed to unlock the lock and to change the combination, but in which the actuator cannot be used to change the combination until a stop mechanism is rendered ineffective.

Yet another object of the invention is to provide a combination lock of the aforesaid type in which the same stop mechanism permits the combination to be changed without holding the actuator manually.

Briefly stated, in one of its broad aspects, a combination lock in accordance with the invention comprises actuator means movable in a predetermined direction from a rest position to an unlocking position, only when the lock is on-combination, to unlock the lock, and further movable in said predetermined direction beyond the unlocking position to a combination-changing position to permit the combination to be changed, stop means normally effective to prevent movement of the actuator means to the combination-changing position, and manually operable means for rendering the stop means ineffective.

BRIEF DESCRIPTION OF THE DRAWINGS

The foregoing and other objects and features of the invention will become more fully apparent upon consideration of the following detailed description of the invention taken in conjunction with the accompanying drawings, which illustrate a preferred and exemplary embodiment of the invention, and wherein.

DESCRIPTION OF THE PREFERRED EMBODIMENT

Figure 1:
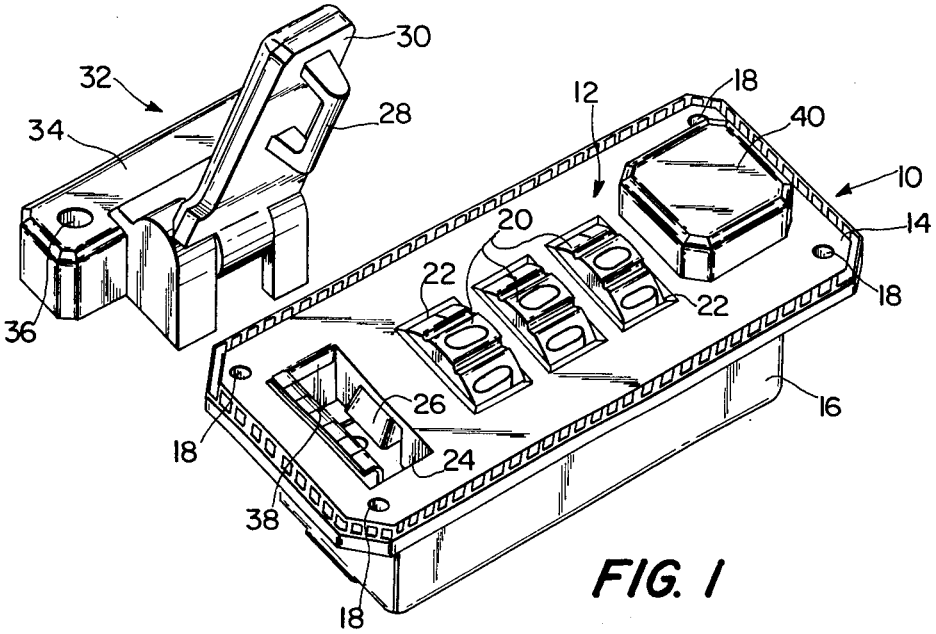
FIG. 1 is a perspective view showing the external appearance of a combination lock in accordance with the invention.
Figure 11:
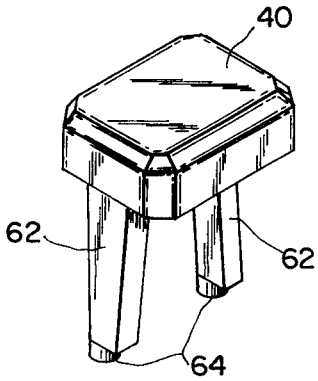
FIG. 11 is a perspective view of an actuator which may be employed in the invention.

Referring to the drawings, and initially to FIG. 1, a combination lock 10 in accordance with the invention may comprise a case or housing 12 including a plate 14 and a frame 16. The case may be mounted on a panel or wall of luggage, for example, by inserting the frame 16 in a corresponding hole in the wall and attaching the plate to the wall by means of rivets in holes 18 of the plate. At the face of the lock, peripheral portions of three combination dials 20 are exposed through slots 22 in plate 14. A slot 24 in plate 14 provides access to a latch member 26, which cooperates with an eye member 28, for example. The eye member may be integral with a tongue 30 of a hasp 32 having a base 34 pivotally supporting the tongue. Tongue 30 may be biased away from case 12 by a spring (not shown) forming part of the mechanism of hasp 32. The hasp may be mounted on another panel or wall that is to be held closed with respect to the panel or wall on which case 12 is mounted. For this purpose rivets may be inserted in corresponding holes 36 at opposite ends of base 34 (only one hole being shown in FIG. 1). Protruding from slot 24 at one end of plate 14 is an operator 38 of a plunger employed in changing the combination, as will be described later. At the opposite end of plate 14 is an actuator 40 employed to unlock the lock and also used in changing the combination.

Figure 10:
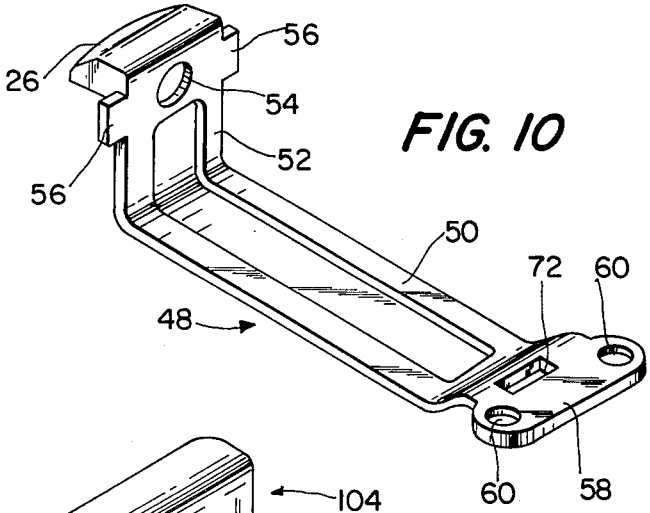
FIG. 10 is a perspective view of a slide which may be employed in the invention.
Figure 2:
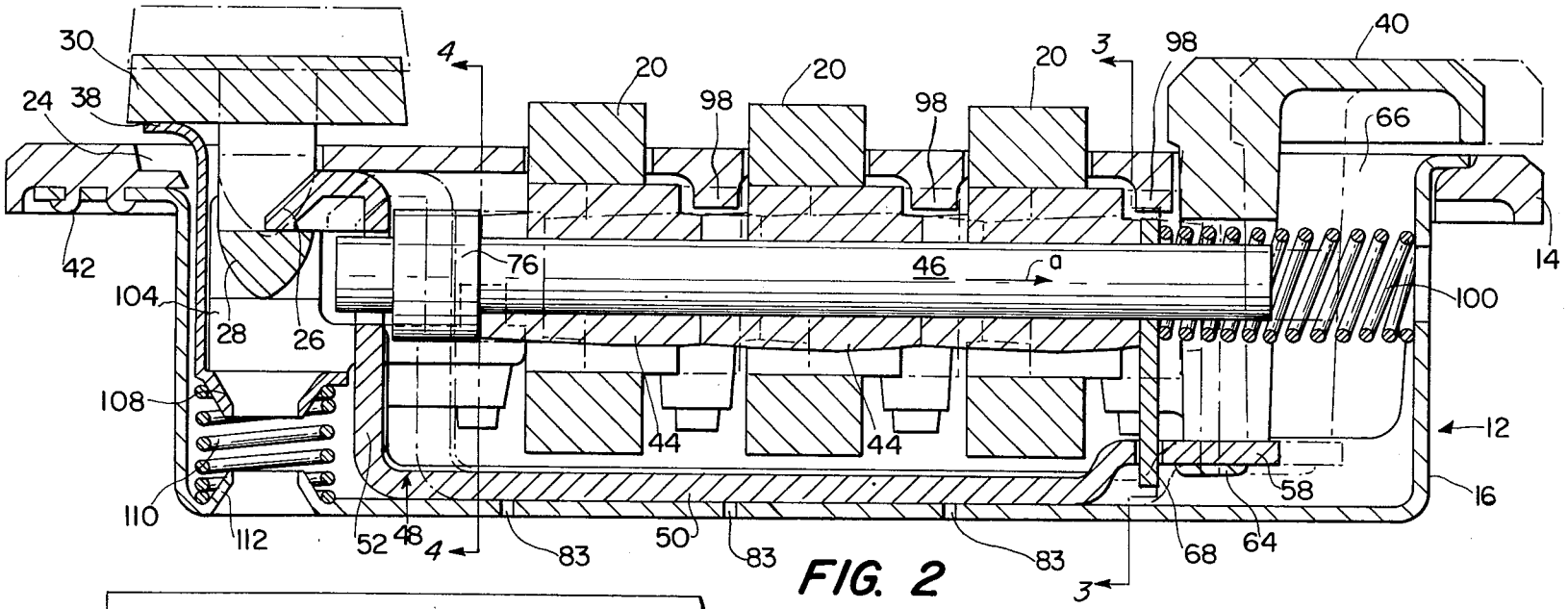
FIG. 2 is a longitudinal sectional view of the lock illustrating the manner in which the lock is opened.

As shown in FIG. 2, plate 14 and frame 16 may be assembled to form the case 12 in a conventional manner, as by means of rivets 42 integral with the plate. Housed within case 12 are the dials 20 and corresponding sleeves 44 supported on a shaft 46 for rotation about the axis of the shaft. Also housed in case 12 is a slide 48 (see FIG. 10) having a base portion 50 movable longitudinally along the bottom of frame 16. An end portion 52 of the slide extends transversely to the base portion 50 and has a hole 54 for supporting one end of shaft 46. The free extremity of end portion 52 constitutes the latch member 26 and is tapered as shown for camming engagement with the correspondingly tapered eye member 28. Laterally extending lugs 56 constitute stop elements for limiting the longitudinal movement of slide 48, as will be described later. The opposite end portion 58 of the slide has a pair of holes 60 which receive depending legs 62 of the actuator 40. Integral rivets 64 at the bottom of legs 62 may be employed to attach the actuator to the slide 48 as shown in FIG. 2, so that the actuator becomes, in effect, part of the slide. Actuator 40 projects from the case 12 through a slot 66 in plate 14. A bracket 68 is attached to slide 48, as by means of an integral stud 70 (see FIG. 3) inserted in a slot 72 in end portion 58 of the slide, and is also in effect part of the slide. The bracket supports the remaining end of the shaft 46, which extends through a hole 74 in bracket 68.

Figure 7:
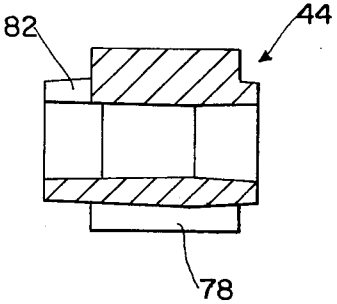
FIG. 7 is a longitudinal sectional view of the sleeve.
Figure 6:
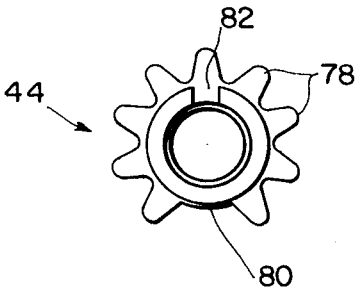
FIG. 6 is an end view of a sleeve which may be employed in the invention.

Sleeves 44 are arranged on shaft 46 in sequence between bracket 68 and a shoulder 76 on the shaft. Each sleeve 44 in the sequence abuts the next sleeve in the sequence. The sleeve at one end of the sequence engages bracket 68, and the sleeve at the opposite end of the sequence engages the shoulder 76. The sleeves are preferably shaped as shown in FIGS. 6 and 7, having external gear teeth 78 spaced evenly about the periphery of the sleeve, but with one tooth missing to provide a gap 80. It is apparent in FIG. 7 that teeth 78 do not extend the full length of the sleeve and are closer to one end of the sleeve than to the other. Also, each sleeve may be provided with a recess 82 at a point opposite the gap 80 so that the existing combination may be determined when the back of case 12 is exposed, as described in U.S. Pat. No. 3,597,945, by passing a fine wire into each of holes 83 in the frame 16 until the recesses 82 are located.

Figure 3:
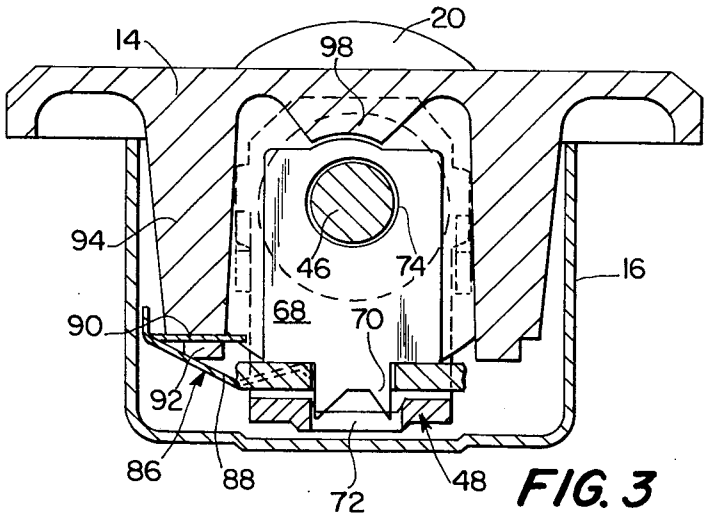
FIGS. 3 and 4 are transverse sectional views taken along lines 3—3 and 4—4, respectively, in FIG. 2.
Figure 9:
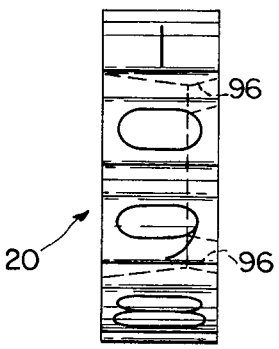
FIG. 9 is a side elevation view of the dial.
Figure 8:
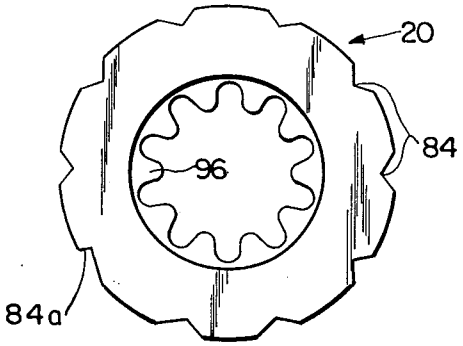
FIG. 8 is an end view of a dial which may be employed in the invention.

The dials 20 preferably have the configuration shown in FIGS. 8 and 9. Each dial has numerals or other combination characters spaced evenly about the periphery of the dial and has notches 84 located between the successive numerals for engagement with a dial spring 86, as shown in FIG. 3. The dial spring may have a plurality of leaf spring arms 88 struck from a common plate 90, which may be supported on rivets 92 formed at the ends of studs 94 integral with plate 14. The free ends of arms 88 may be shaped to form detents as shown in dotted lines in FIG. 3, which pass smoothly into and out of the notches 84. As shown and described in the aforementioned patents, all of notches 84, except one notch **84*a*, preferably have symmetrically divergent walls so that each dial may be turned in either direction past its spring arm 88 and be held releasably when stopped with a notch 84 receiving the end of its arm 88. Notch 84*a* has one wall that extends generally radially of the dial, so that when the dial is turned in one direction, the end of the cooperating spring arm 88 will eventually engage the radial wall of notch 84*a* and stop the rotation of the dial at a zero-index point. Rotation of the dial in the opposite direction is not impeded by the radial wall of notch 84*a***.

Each dial is formed with internal gear teeth 96 at one end of the dial. These gear teeth normally mesh with gear teeth 78 of a sleeve 44, each sleeve fitting within a corresponding dial 20 and supporting the dial thereon as shown in FIG. 2. Thus, the sleeves are normally coupled to and turn with the dials.

Except when the dials are on-combination, and the sleeves 44 have a predetermined orientation, abutments 98, which may be integral with plate 14 (see FIGS. 2 and 5) block movement of the sleeves 44 relative to the dials 20 along the axis of shaft 46 in the direction of arrow *a* in FIG. 2. When the dials are on-combination, the sleeves are oriented so that each gap 80 is aligned with an adjacent abutment 98 in order that the sleeves may clear the abutments and move in the direction of arrow *a*. Movement of the sleeves in that direction is accomplished by manually moving the actuator 40 in that direction, from its rest position shown in full lines in FIG. 2 to its unlocking position shown in phantom lines, which moves the slide 48 in the same direction. End portion 52 of the slide engages on end of shoulder 76 of shaft 46, and the opposite end of the shoulder engages the adjacent sleeve 44. Since the sleeves are all in contact with one another, they all move in the direction of arrow *a* along with shaft 46. At the same time, the latch member 26 is moved from a closed position (shown in full lines in FIG. 2) to an open position (shown in phantom lines) and is withdrawn from the eye member 28, releasing the tongue 30.

When the sleeves are moved as indicated in FIG. 2, they remain coupled to dials 20, since gear teeth 78 do not move sufficiently to become disengaged from gear teeth 98 of the dials. The gear teeth 78 at opposite sides of gaps 80 embrace the associated abutments 98 when the sleeves are in the phantom line position of FIG. 2, and thus dials 20 cannot be turned until actuator 40 is returned to its rest position. When manual pressure on actuator 40 ceases, a coil spring 100, surrounding an end of shaft 46, moves bracket 68 in the direction opposite to arrow *a*. Since the bracket engages an adjacent sleeve 44, all of the sleeves are moved in the same direction. The assembly of sleeves 44, shaft 46, slider 48, and actuator 40 is thus returned to its normal rest position.

Figure 12:
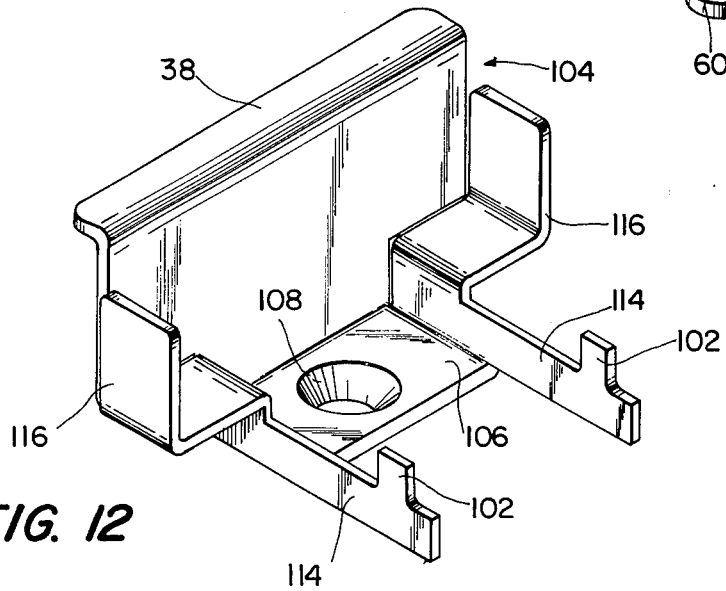
FIG. 12 is a perspective view of a plunger which may be employed in the invention.
Figure 4:
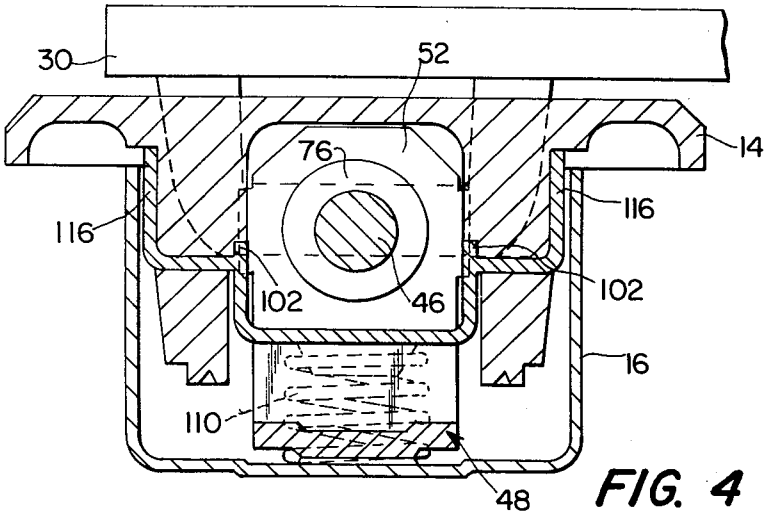
Figure 13:
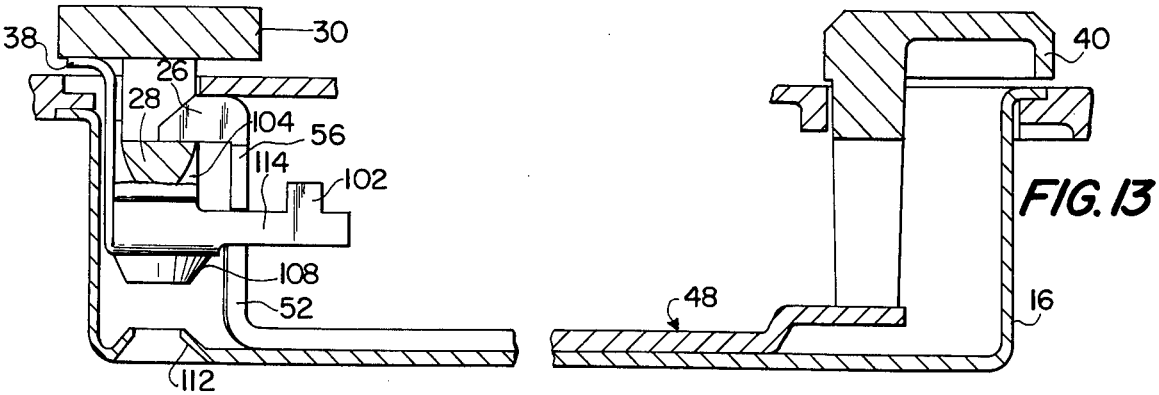
FIGS. 13–16 are somewhat diagrammatic longitudinal sectional views illustrating different operating conditions of the lock.

Movement of actuator 40 in the direction of arrow *a* is normally limited so that the sleeves cannot move sufficiently to become disengaged from the dials. For this purpose stop elements 56 of slide 48 (FIG. 10) engage cooperating stop elements 102 of a plunger 104 (FIG. 12). Operator 38 of the plunger was referred to previously in the description of FIG. 1. The operator extends from a base portion 106 of the plunger, the base portion having a protuberance 108 that is received in one end of a coil spring 110, the other end of which fits over a protuberance 112 of the frame 16 as shown in FIG. 2. Spring 110 normally biases plunger 104 to a position at which the operator 38 projects from slot 24 as shown. Stop elements 102 of the plunger extend from arms 114 which have laterally extending guide portions 116 for guiding the movement of the plunger between opposite walls of the frame 16 as shown in FIG. 4. In the normal rest position of plunger 104, stop elements 102 are in the path of movement of stop elements 56 in the direction of arrow *a* in FIG. 2. When slide 48 is moved in that direction, one side of stop elements 56 engages one side of elements 102, blocking further movement of slide 48 and preventing actuator 40 from moving to its combination-changing position. FIG. 13 shows the position of slide 48 relative to plunger 104 in the normal closed condition of the lock, while FIG. 14 shows the relative positions of parts 48 and 104 in the open condition of the lock, with stop elements 56 blocked by stop elements 102.

Figure 14:
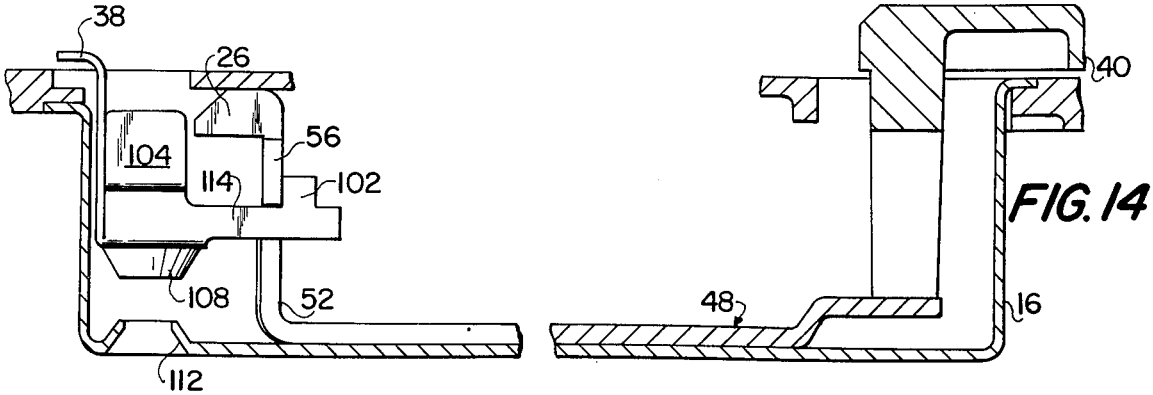
Figure 15:
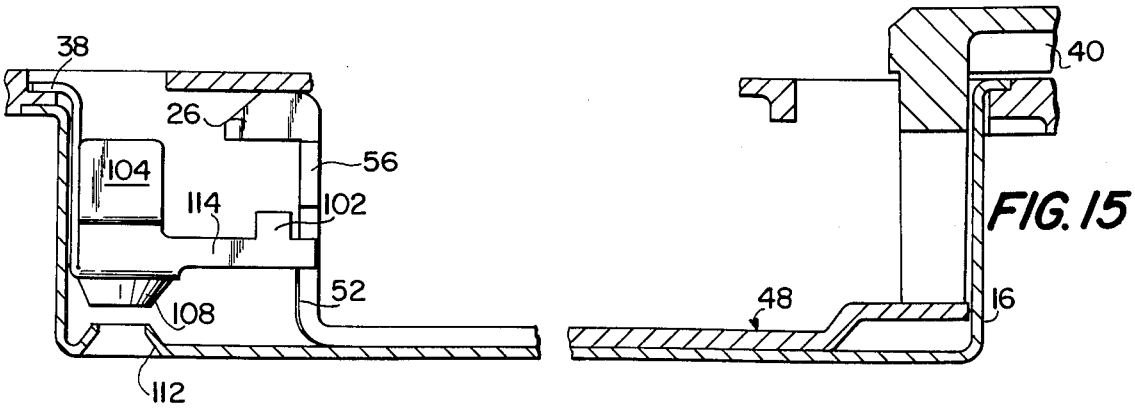

To change the combination, actuator 40 must be moved beyond its unlocking position, shown in FIG. 14, to a combination-changing position. To accomplish this, operator 38 of plunger 104 must be depressed momentarily, as shown in FIG. 15, to move stop elements 102 out of the path of stop elements 56, rendering the stop mechanism ineffective, so that the assembly of actuator 40, slide 48, sleeves 44, and shaft 46 can continue to move in the direction of arrow *a* to the position shown in FIG. 5. Slide 48 and plunger 104 then have the positions shown in FIG. 15. If manual pressure on operator 38 of the plunger 104 is released, the plunger will move to the position shown in FIG. 16. This causes stop elements 102 to be reinserted into the path of stop elements 56 as shown. Manual pressure on actuator 40 can then be terminated, and when spring 100 moves slide 48 in a return direction opposite to arrow *a* in FIG. 5, stop elements 56 will again engage stop elements 102, but at the side opposite to the initial engagement described above, as shown in FIG. 16, to prevent further movement of the slide 48 and the sleeves 44 in the return direction.

Figure 5:
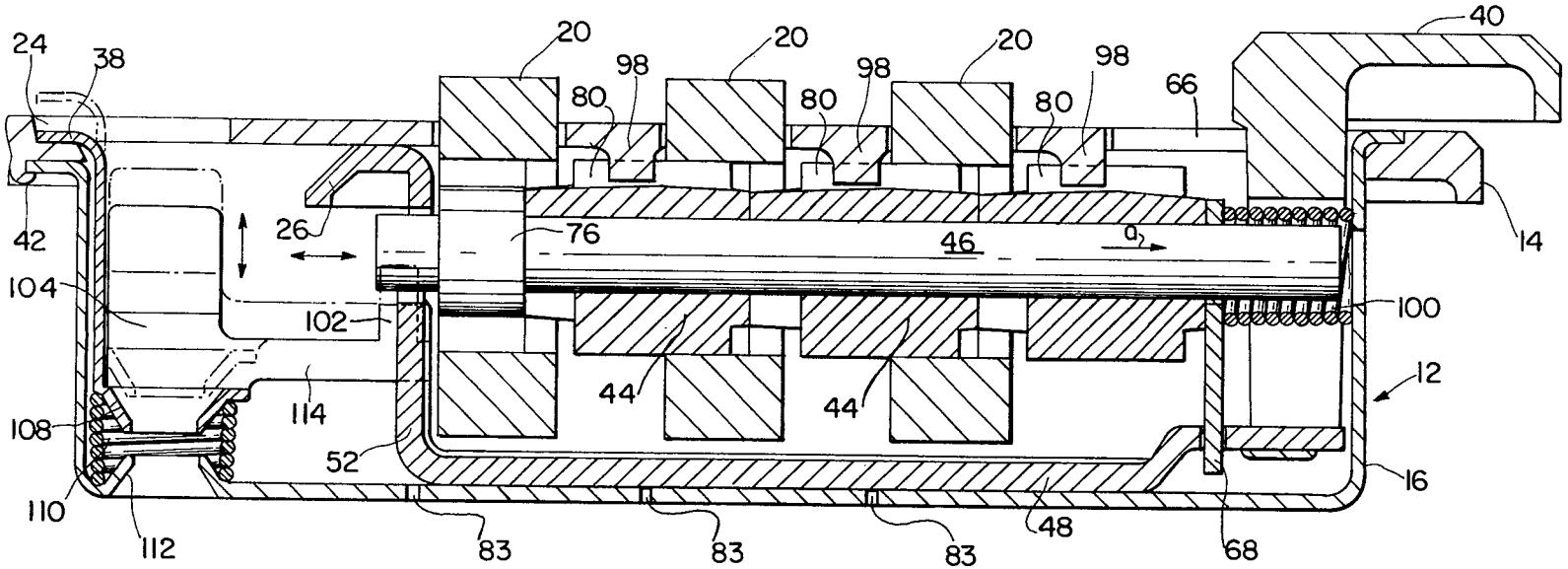
FIG. 5 is a longitudinal sectional view of the lock illustrating the manner in which the combination is changed.
Figure 16:
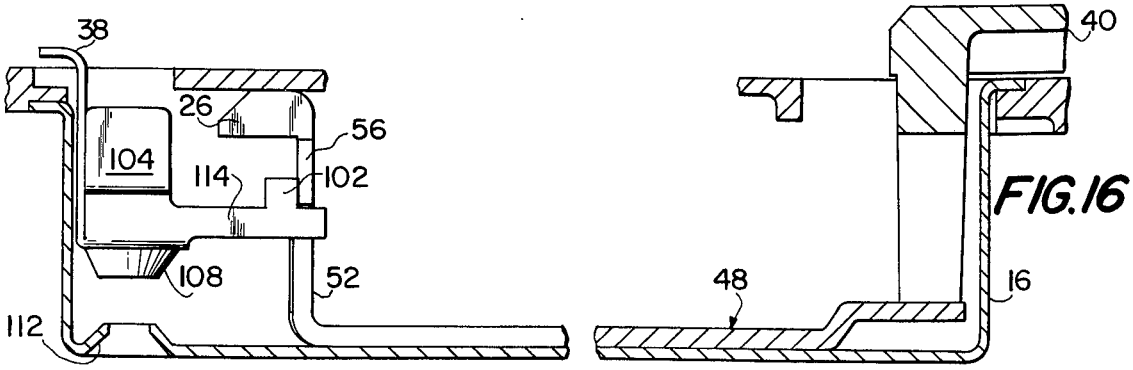

In the combination-changing position, shown in FIG. 16, the gear teeth 78 of sleeves 44 are disengaged from the gear teeth 96 of dials 20, as they are in FIG. 5 just prior to manual release of actuator 40, so that the sleeves are uncoupled from the dials. Dials 20, now free of sleeves 44, may be turned relative to the sleeves for choosing a new combination. If then the operator 38 is depressed again, stop elements 56 will be disengaged from stop elements 102. Spring 100 will then move the assembly of actuator 40, slide 48, shaft 46, and sleeves 44 in the direction opposite to arrow *a*, returning the parts to their normal rest position and re-coupling the sleeves to the dials.

It is apparent from the foregoing description that the preferred embodiment of the invention provides a simple combination lock in which an actuator which moves in a predetermined direction to unlock the lock is moved further in that direction for changing the combination. The actuator is only permitted to move to its combination-changing position when the lock is unlocked and only when a stop mechanism has been rendered ineffective by depressing a manual operator. Moreover, the actuator need not be held manually during the changing of the combination, and the parts return automatically to their normal rest position when the operator of the stop mechanism is depressed again after the combination is changed. As shown in FIG. 2, the manual operator is covered or hidden when the latch member is in engagement with the tongue of the hasp. The operator is exposed at the face of the lock only when the lock is unlocked, as shown in FIG. 1.

While a preferred form of the invention has been shown and described, it will be apparent to those skilled in the art that changes can be made in this embodiment without departing from the principles and spirit of the invention, the scope of which is defined in the appended claims. For example, within the broader aspects of the invention, slide 48 could move relative to sleeves 44 in the direction of arrow *a* to open the latch, such movement being blocked by interference between the slide and the sleeves except when the dials are on-combination, and then the slide could move the sleeves to uncouple them from the dials when the actuator is moved to the combination-changing position. Also, the shaft 46 could be stationary, with the slide and the sleeves being moved along the shaft by the actuator.

The invention claimed is:

1. A combination lock comprising actuator means movable in a predetermined direction from a rest position to an unlocking position, only when the lock is on-combination, to unlock the lock, and further movable in said predetermined direction beyond the unlocking position to a combination-changing position to permit the combination to be changed, stop means normally effective to prevent movement of the actuator means to the combination-changing position, and manually operable means for rendering the stop means ineffective.

2. A combination lock in accordance with claim 1, wherein the lock comprises a plurality of combination dials rotatable about a common axis, each dial having an associated sleeve rotatable about the same axis and normally coupled to the dial for rotation therewith, latch means moved from a closed position to an open position in response to movement of the actuator means from its rest position to its unlocking position, and blocking means cooperable with the sleeves for preventing the actuator means from moving the latch means to its open position except when the sleeves have a predetermined orientation.

3. A combination lock in accordance with claim 2, wherein the sleeves are moved along said axis in said predetermined direction in response to movement of the actuator means to its unlocking position and wherein the blocking means prevents the movement of the sleeves in said direction except when the sleeves have said predetermined orientation.

4. A combination lock in accordance with claim 2, wherein the sleeves are moved along said axis in said predetermined direction and are uncoupled from the dials in response to movement of the actuator means to its combination-changing position, so that the dials may be turned relative to the sleeves to change the combination.

5. A combination lock in accordance with claim 4, further comprising spring means for normally urging the sleeves in a direction opposite to said predetermined direction, further stop means effective to prevent movement of the sleeves in said opposite direction after they have been uncoupled from the dials, and manually operable means for rendering the further stop means ineffective.

6. A combination lock in accordance with claim 5, wherein both of the stop means are rendered ineffective by a single operator.

7. A combination lock in accordance with claim 6, wherein the operator is exposed at a face of the lock only when the lock is unlocked.

8. A combination lock in accordance with claim 5, wherein the sleeves are supported on a shaft and the dials are supported on the associated sleeves, the sleeves being arranged in sequence with each sleeve abutting the next sleeve in the sequence, and wherein the sleeves are moved in said predetermined direction by slide means which pushes a sleeve at one end of the sequence, and thereby the other sleeves, in said predetermined direction.

9. A combination lock in accordance with claim 8, wherein the shaft is supported on the slide means and moves axially with the slide means.

10. A combination lock in accordance with claim 8, wherein both of the stop means comprise a common stop element movable into the path of the slide means for blocking movement of the slide means.

11. A combination lock in accordance with claim 10, wherein the stop element is spring biased into the path of the slide means and is moved out of the path of movement of the slide means by a manual operator.

12. A combination lock in accordance with claim 11, wherein the slide means has another stop element, one side of which is engageable with one side of the first-mentioned stop element to limit movement of the slide means in said predetermined direction and the opposite side of which is engageable with the opposite side of the first-mentioned stop element to limit movement of the slide means in the opposite direction.

13. A combination lock in accordance with claim 12, wherein the sleeves are moved in said predetermined direction by the slide means in response to movement of the actuator means to its unlocking position, the sleeves moving in said predetermined direction relative to the dials but remaining coupled to the dials until the actuator means reaches the combination-changing position.

* * * * *